US009254517B2

(12) United States Patent
Sato et al.

(10) Patent No.: US 9,254,517 B2
(45) Date of Patent: Feb. 9, 2016

(54) UPPER DIE AND TEMPORARY CLAMPING METHOD THEREOF

(71) Applicant: AMADA COMPANY, LIMITED, Kanagawa (JP)

(72) Inventors: Masaaki Sato, Kanagawa (JP); Yousuke Onagi, Kanagawa (JP)

(73) Assignee: AMADA COMPANY, LIMITED, Kanagawa (JP)

( * ) Notice: Subject to any disclaimer, the term of this patent is extended or adjusted under 35 U.S.C. 154(b) by 0 days.

(21) Appl. No.: 14/402,765

(22) PCT Filed: May 21, 2013

(86) PCT No.: PCT/JP2013/064073
§ 371 (c)(1),
(2) Date: Nov. 21, 2014

(87) PCT Pub. No.: WO2013/176124
PCT Pub. Date: Nov. 28, 2013

(65) Prior Publication Data

US 2015/0143867 A1 May 28, 2015

(30) Foreign Application Priority Data

May 23, 2012 (JP) ..... 2012-117577

(51) Int. Cl.
*B21D 37/00* (2006.01)
*B21J 13/03* (2006.01)
*B21D 5/02* (2006.01)

(52) U.S. Cl.
CPC ..... *B21J 13/03* (2013.01); *B21D 5/0236* (2013.01)

(58) Field of Classification Search
CPC ..... B21J 13/03; B21D 37/04; B21D 37/06
USPC ..... 72/482.1
See application file for complete search history.

(56) References Cited

U.S. PATENT DOCUMENTS

| | | | | |
|---|---|---|---|---|
| 7,021,116 | B2 * | 4/2006 | Harrington et al. | 72/482.91 |
| 7,721,586 | B2 * | 5/2010 | Pabich et al. | 72/481.1 |
| 7,810,369 | B2 * | 10/2010 | Rouweler et al. | 72/482.1 |
| 8,099,992 | B2 * | 1/2012 | Rouweler et al. | 72/481.2 |

(Continued)

FOREIGN PATENT DOCUMENTS

| | | |
|---|---|---|
| JP | 62-189820 | 12/1987 |
| JP | 2003-134644 | 5/2003 |

(Continued)

OTHER PUBLICATIONS

Search report from Japan, mail date is Aug. 27, 2013.

*Primary Examiner* — David B Jones
(74) *Attorney, Agent, or Firm* — Greenblum & Bernstein, P.L.C.

(57) ABSTRACT

An upper die is removable in an up-down direction with respect to an upper die mounting groove that is arranged in a left-right direction at a lower part of an upper table of a press brake. The upper die includes a stop piece having a stop projection that is engageable with a stop groove that is formed in the left-right direction in each of upper die contact faces which face each other in a front-rear direction, the stop piece being movable out of and into a surface of the upper die and pushed in a direction to project out of the surface of the upper die. A bottom face of the stop projection for engaging with the stop groove is an inclined face that rises toward a front end of the stop projection.

5 Claims, 6 Drawing Sheets

(56) References Cited

U.S. PATENT DOCUMENTS

| | | | | |
|---|---|---|---|---|
| 2003/0061680 | A1 | 4/2003 | Uchida | |
| 2007/0144232 | A1* | 6/2007 | Shimota et al. | 72/481.1 |
| 2009/0217731 | A1 | 9/2009 | Rouweler et al. | |
| 2011/0247389 | A1* | 10/2011 | Rouweler et al. | 72/389.3 |

FOREIGN PATENT DOCUMENTS

| | | |
|---|---|---|
| JP | 2009-033870 | 2/2009 |
| JP | 2009-514680 | 4/2009 |
| WO | 00/41824 | 7/2000 |
| WO | 2007/054121 | 5/2007 |

* cited by examiner (A)

| TAPER ANGLE (DEGREE) | | 0 | 5 | 10 | 15 | 20 | 25 | 30 | 45 | 60 |
|---|---|---|---|---|---|---|---|---|---|---|
| LIFT QUANTITY (mm) | ΔY=tanΘ*st | 0 | 0.087st | 0.176st | 0.268st | 0.364st | 0.466st | 0.577st | 1.000st | 1.732st |
| FORCE (kgf) | P'=FsinΘ | 0.00 | 0.087F | 0.174F | 0.259F | 0.342F | 0.423F | 0.500F | 0.707F | 0.866F |
| | P'x=P'sinΘ | 0.00 | 0.008F | 0.030F | 0.067F | 0.117F | 0.179F | 0.250F | 0.500F | 0.750F |
| | P'y=P'cosΘ | 0.00 | 0.087F | 0.171F | 0.250F | 0.321F | 0.383F | 0.433F | 0.500F | 0.433F |
| VERTICAL DIE LIFTING FORCE Py = P'y − W (DIE WEIGHT) (kgf) | Py=P'y-W | 0-W | 0.087F-W | 0.171F-W | 0.250F-W | 0.321F-W | 0.383F-W | 0.433F-W | 0.500F-W | 0.433F-W |

(B)

UPPER DIE AND TEMPORARY CLAMPING METHOD THEREOF

TECHNICAL FIELD

The present invention relates to an upper die that is removable in an up-down direction with respect to an upper die mounting groove that is arranged in a left-right direction at a lower part of an upper table of a press brake, as well as to a temporary clamping method of an upper die with respect to the upper die mounting groove. More precisely, the present invention relates to an upper die and a temporary clamping method of an upper die that cause no small displacement at an upper die mounting position when the upper die temporarily clamped in the upper die mounting groove is firmly clamped in the upper die mounting groove.

BACKGROUND ART

A press brake has an upper table and a lower table that are elongated in a left-right direction and vertically faced to each other. The upper table or the lower table is configured as a ram that is vertically movable. A lower part of the upper table is provided with an upper die mounting part to which an upper die is mounted. An upper part of the lower table is provided with a lower die mounting part to which a lower die is mounted. Removing and replacing a die with respect to the upper or lower die mounting part is carried out manually or automatically with the use of, for example, a robot as disclosed in, for example, Published PCT International Application No. WO00/41824 (Patent Literature 1).

SUMMARY OF INVENTION

Problems to be Solved by Invention

An upper die mounting part described in Patent Literature 1 is constituted as illustrated in FIG. 1. In a press brake (an overall constitution thereof is not illustrated), an upper table 1 is integrally provided with, at a lower part thereof, an upper die holder 3 that is elongated in a left-right direction (a direction orthogonal to the plane of FIG. 1). The upper die holder has an upper die mounting groove 5 that is opened downward and elongated in the left-right direction.

In more detail, the upper die mounting groove 5 has an upper face 5U and front and rear upper die contact faces 5F and 5R that are at front and rear positions and face each other. In the vicinities of lower parts of the front and rear upper die contact faces 5F and 5R, there are formed respective stop grooves 7 that are elongated in the left-right direction. To clamp an upper die 9 mounted to the upper die mounting groove 5, the upper die holder 3 is provided with a lock piece 13 that is engageable with a horizontal V-groove 11 formed at an upper part of the upper die 9 and is provided with a V-shape engaging part. The lock piece 13 is elongated in the left-right direction and is moved back and forth by an actuator 15 such as a hydraulic pressure cylinder provided for the upper die holder 3.

The upper die 9 has, at a lower part thereof, a bending part that cooperates with a lower die (not illustrated) to carry out a bending process on a sheet work. The upper die 9 has, at an upper part thereof, a mounting part 17 that is attached to and removed from the upper die mounting groove 5. In each of front face (left side face in FIG. 1) and back face (right side face in FIG. 1) of the mounting part 17 has the V-groove 11 that is elongated in the left-right direction. The mounting part 17 of the upper die 9 is provided with a stop piece 19 that is engageable with the stop groove 7 and movable out of and into the front face mentioned above. The stop piece 19 is pushed with, for example, a coil spring in a projecting direction.

In the configuration illustrated in FIG. 1, the locked state by the lock piece 13 is released and the stop piece 19 is pushed against the biasing force of the coil spring to release the stopped state with respect to the stop groove 7. Then, the upper die 9 is removable in a downward direction. Namely, the upper die 9 is mountable to and removable from the upper die mounting groove 5 in an up-down direction. In a temporarily clamped state in which the stop piece 19 is fitted in the stop groove 7, the upper die 9 is movable and adjustable in the left-right direction along the upper die mounting groove 5.

After the upper die 9 is temporarily clamped as mentioned above, the actuator 15 is driven to project the lock piece 13. Then, the upper die 9 is slightly pushed and moved leftward in FIG. 1, and at the same time, is slightly pushed and moved upward due to an upward component force produced by the engagement of the lock piece 13 with the V-groove 11. Namely, the upper die 9 is brought into contact with the upper die contact face 5F and upper face of the upper die mounting groove 5, thereby being positioned and clamped.

In the temporarily clamped state of the upper die mentioned above, a small gap between the upper die mounting groove 5 and the mounting part 17 of the upper die 9 causes the upper die 9 to slightly turn and incline in a counterclockwise direction in FIG. 1 around a fulcrum served by a part where the stop piece 19 engages with the stop groove 7. When the lock piece 13 firmly clamps the upper die 9, the slight turn in the counterclockwise direction is returned so that the upper die 9 is clamped in a vertical state. Namely, the upper die 9 slightly swings in a front-rear direction (left-right direction in FIG. 1) when the upper die 9 is firmly clamped from the temporarily clamped state and when it is released from the firmly clamped state to the temporarily clamped state.

FIG. 2 illustrates a press brake configured to use an upper die 9A having a minimum usable width. The press brake is provided with a plurality of lock pieces 13A each being a pin whose diameter is substantially equal to the width of the upper die 9A. The lock pieces 13A are arranged in a longitudinal (left-right) direction at predetermined regular pitches along an upper die mounting groove 5. An upper die 9 whose width is smaller than a predetermined value is provided with a stop piece 19 at a central part of the width of the upper die 9.

When the upper die 9A is mounted to the upper die mounting groove 5 in the above-mentioned configuration, there is a case that the upper die 9A faces one of the lock pieces 13A, or a case that the upper die 9A is shifted from one of the lock pieces 13A, or a case that the upper die 9A is supported with two of the lock pieces 13A that are widthwise adjacent to the upper die 9A. When the upper die 9A is shifted from one of the lock pieces 13A as illustrated in FIG. 2(A) and is temporarily clamped in this state and when the lock piece 13A is projected to press and clamp the upper die 9A with respect to an upper die contact face 5F, the upper die 9A is temporarily supported with the lock piece 13 in the shifted state. Accordingly, when the upper die 9A is firmly clamped from the temporarily clamped state, the upper die 9A is slightly swung and inclined in a counterclockwise direction in FIG. 2(A) and is supported in this state. Namely, the upper die 9A inclines as exaggeratedly illustrated with an imaginary line in FIG. 2(B). When the lock piece 13A pushes and firmly clamps the upper die 9A, an upper face of the upper die 9A comes into contact with an upper face 5U of the upper die mounting groove 5 and the above-mentioned slight inclination is canceled to establish a vertical state. Namely, the upper die 9A is slightly displaced in the left-right direction as illustrated in FIG. 2(C).

Accordingly, when the upper die 9A is firmly clamped from the temporarily clamped state, or when it is released to the temporarily clamped state, the upper die 9A is sometimes slightly swung in the left-right direction and slightly displaced in the left-right direction in FIG. 2. Even in the case that the upper die 9A is supported with the adjacent two lock pieces 13A, a slight operational delay between the two lock pieces 13A may cause a slight displacement in the left-right direction. When a plurality of the upper dies 9A are arranged in the left-right direction at predetermined pitches to carry out a bending process at predetermined locations on a plurality of works, problems may arise that small errors occur in the left-right pitches among the plurality of upper dies 9A and the upper dies 9A are slightly displaced from the bending process locations.

Means to Solve Problems

In consideration of the above-mentioned problems, the present invention provides an upper die that is removable in an up-down direction with respect to an upper die mounting groove that is arranged in a left-right direction at a lower part of an upper table of a press brake. The upper die includes a stop piece having a stop projection that is engageable with a stop groove that is formed in the left-right direction in each of upper die contact faces of the upper die mounting groove, the upper die contact faces facing each other in a front-rear direction. The stop piece is movable out of and into a surface of the upper die and is pushed in a direction to project out of the surface of the upper die. A bottom face of the stop projection to be engaged with the stop groove is formed into an inclined face that rises toward a front end of the stop projection.

MODE OF IMPLEMENTING INVENTION

Figure 1:
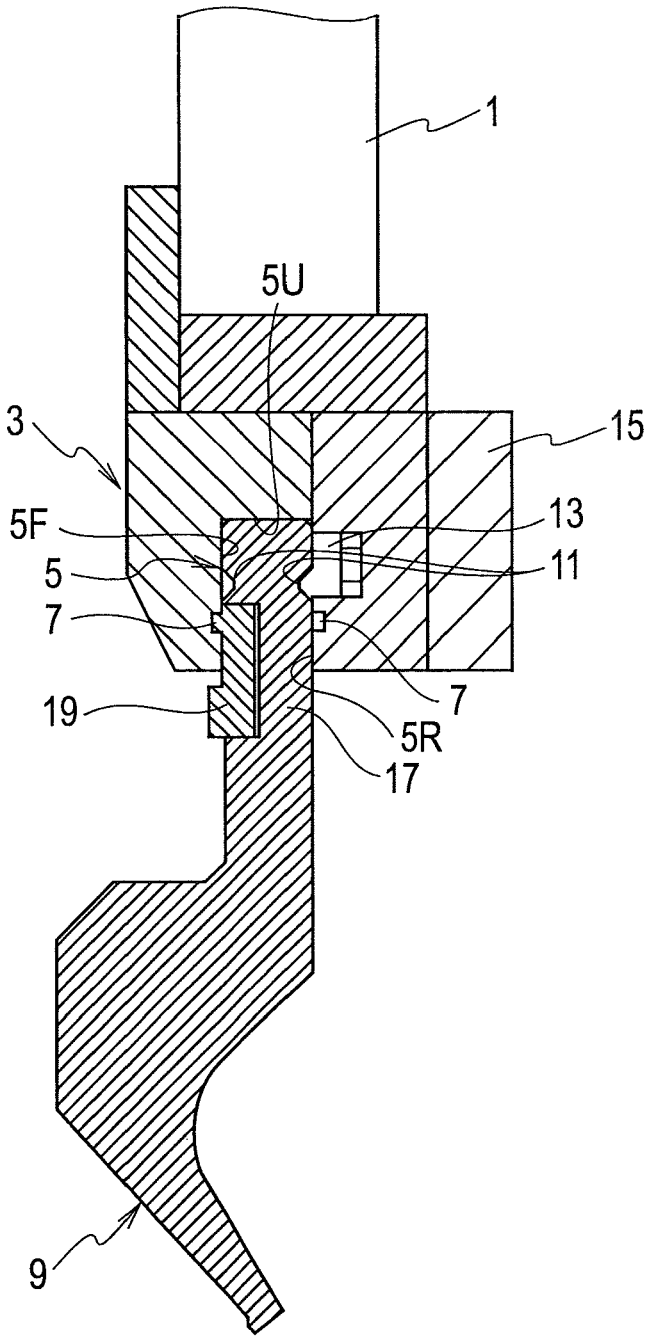
FIG. 1 is an explanatory view illustrating a general configuration to removably mount an upper die to a lower part of an upper table of a press brake.

Embodiments of the present invention will be explained with reference to the drawings. Structural elements having the same functions as those of the above-mentioned general configuration are represented with the same reference marks to omit overlapping explanations.

An upper die 9B according to an embodiment of the present invention has, similar to the upper die 9 mentioned above, a mounting part 17 that is engageable with an upper die mounting groove 5 of an upper die holder 3. At a central part in a width direction (a direction orthogonal to the plane of FIG. 3(A)), the mounting part 17 is provided with a stop piece 19A that corresponds to the stop piece 19 mentioned above. The stop piece 19A is retractable into a receiving groove 21 that is formed in a surface of the mounting part 17 and is extended in an up-down direction. The stop piece 19A is also projectable from the surface of the mounting part 17.

In more detail, the stop piece 19A has a stop piece body 23 extending in the up-down direction. A surface around a lower end of the stop piece body 23 has a projecting part 25 serving as a push button. The projecting part 25 has a screw hole 27 formed in a front-rear direction (a left-right direction in FIG. 3(B)). Into the screw hole 27, a front end part of a temporary clamping screw 29 is fastened. The temporary clamping screw 29 is movable through the upper die 9B in the front-rear direction. Between a back face of the stop piece body 23 and the mounting part 17, a resilient member 30 such as a coil spring is arranged to bias the stop piece body 23 so that the stop piece body 23 may project out of the surface of the mounting part 17.

A surface of an upper part of the stop piece body 23 has a stop projection 31 that is engageable with a stop groove 7 formed in the upper die mounting groove 5. An upper face of the stop projection 31 is an upper inclined face 33 that is inclined so that the thickness of an upper end part of the stop piece body 23 gradually thins in the front-rear direction (the left-right direction in FIG. 3(B)). A bottom face 35 of the stop projection 31 is an inclined face that is caught by a lower edge 7L of the stop groove 7 and is inclined so that a front end side of the stop projection 31 rises.

Figure 3:
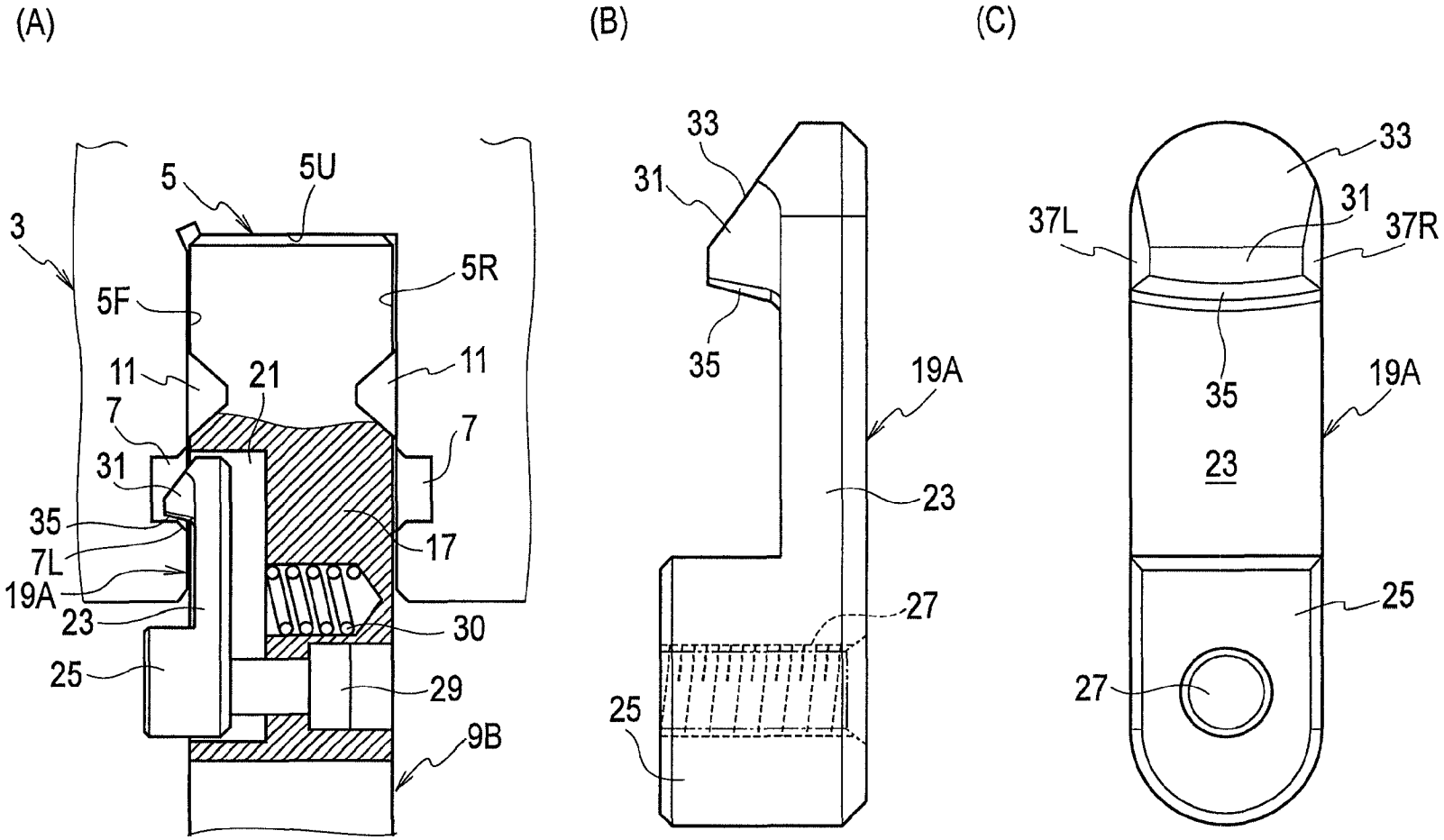
FIG. 3 is an explanatory view illustrating configurations of an upper die mounting part and a stop piece according to an embodiment of the present invention.

In addition, the bottom face 35 of the stop projection 31 has an arcuate shape around the center of an axis extending in the front-rear direction (a direction orthogonal to the plane of FIG. 3(C)). Namely, the bottom face 35 is inclined so that the front end side of the stop projection 31 rises and has an arc-like shape around the front-rear axis, so that the bottom face 35 is like a part of the circumferential face of a truncated cone. Left and right side faces 37L and 37R of the stop projection 31 are formed to gradually narrow the left-right width of the stop projection 31 toward the front end of the stop projection 31. Namely, these side faces are sloped in the left-right direction to gradually narrow the front end side of the stop projection 31.

In FIG. 3(A), the mounting part 17 of the upper die 9B is mounted to the upper die mounting groove 5 of the upper die holder 3. When the projecting part 25 of the stop piece 19A is pressed against the pushing force of the resilient member 30, the stop piece body 23 retracts into the receiving groove 21 and the stop projection 31 at the upper part of the stop piece body 23 retracts from the surface of the stop piece body 23. As a result, the stop projection 31 is removed from the stop groove 7 of the upper die holder 3, and therefore, the upper die 9B can downwardly be removed.

Contrary to this, the projecting part 25 is pushed to retract the stop piece body 23 into the receiving groove 21 and the mounting part 17 of the upper die 9B is mounted from below to the upper die mounting groove 5 of the upper die holder 3. When the projecting part 25 is released, the pushing force of the resilient member 30 projects the stop piece body 23, so that the stop projection 31 of the stop piece body 23 engages with the stop groove 7. At this time, the bottom face 35 of the stop projection 31 is caught by the lower edge 7L of the stop groove 7 and an upward component force acting on the inclined bottom face 35 lifts and temporarily clamps the upper die 9B.

Figure 2:
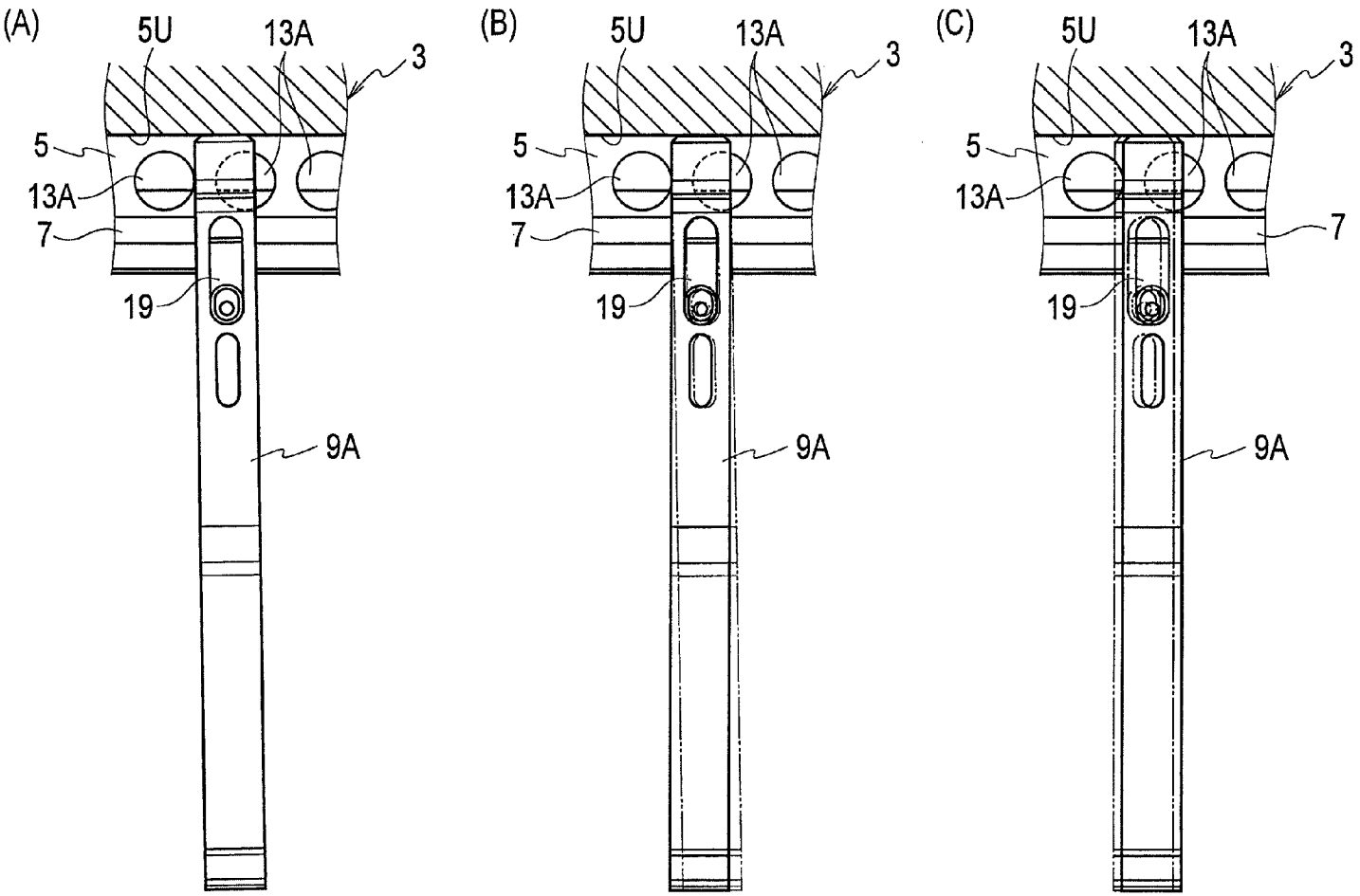
FIG. 2 is an explanatory view illustrating an upper die that is displaced in a left-right direction when firmly clamped in an upper die mounting groove after temporarily clamped therein.

In the above-mentioned temporarily clamped state, the upper die 9B is lifted so that an upper face of the upper die 9B comes into contact with an upper face 5U of the upper die mounting groove 5, or a very small clearance of, for example, 0.15 mm or smaller (0.5 mm or over according to a related art) is kept between the upper face of the upper die 9B and the upper face 5U of the upper die mounting groove 5. This results in eliminating the inclination in the left-right direction explained in connection with FIG. 2, or suppressing the same within an allowable range. Namely, when a lock piece 13A firmly presses and clamps the upper die 9B to an upper die contact face 5F of the upper die mounting groove 5, the upper die 9B causes no displacement in the left-right direction, or such a displacement can be suppressed within an allowable range. As a consequence, the problems mentioned above are solved.

The bottom face of the stop projection 31 of the stop piece 19A is arcuate around the center of the front-rear axis. When the mounting part 17 of the upper die 9B is temporarily clamped in the upper die mounting groove 5, and in this state, when the upper die 9B is moved in a longitudinal direction (left-right direction) along the upper die mounting groove 5, a biting phenomenon can effectively be prevented. If the upper die 9B slightly inclines in the left-right direction, the upper face of the upper die 9B interferes with the upper face 5U of the upper die mounting groove 5 to upwardly push the upper face 5U. At the same time, the bottom face 35 of the stop projection 31 downwardly pushes the lower edge 7L of the stop groove 7. These pushing actions prevent the biting phenomenon.

The left and right side faces 37L and 37R of the stop projection 31 are sloped so that the front end side of the stop projection 31 narrows. This further effectively prevents the biting phenomenon. To prevent the biting phenomenon, the bottom face 35 may have, instead of the arcuate shape, a polygonal shape having inclined faces at left and right sides of the bottom face 35. In this case, the bottom face generally approximates an arcuate shape.

Figure 4:
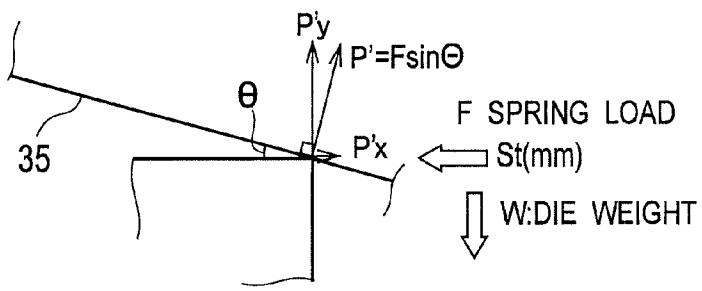
FIG. 4 is an explanatory view illustrating relationships among an inclination angle of a bottom face of a stop projection of the stop piece, a lift quantity, and others.

In FIG. 4(B), an inclination angle at a widthwise central part of the bottom face 35 of the stop projection 31 is θ (theta), a pushing force of the resilient member 30 is F[N] (kgf), and a weight of the upper die 9B is W[N] (kgf). Then, a force P' (kgf) in a direction orthogonal to the inclined bottom face 35 is expressed as $P'=F \sin\theta$. A component force P'y in a vertical direction is expressed as $P'y=P' \cos\theta$ and a component force P'x in a horizontal direction is expressed as $P'x=P' \sin\theta$. The resilient member 30 horizontally pushes and moves the stop piece body 23 by a stroke of St (mm). Then a push-up quantity (lift quantity) ΔY of the upper die 9B is expressed as $\Delta Y=\tan\theta \times St$.

To bring the upper face of the upper die 9B into contact with the upper face 5U of the upper die mounting groove 5, the lift quantity DeltaY must be greater than a clearance between the upper face of the upper die 9B and the upper face 5U of the upper die mounting groove 5 at the time of temporarily clamping the upper die 9B in the upper die mounting groove 5. A lifting force Py of lifting the upper die 9B is expressed as $Py=P'y-W$. Here, it is necessary to satisfy $Py>0$. Considering a frictional force occurring when lifting the upper die 9B, it is preferable that P'x takes a minimum value. To satisfy these conditions, it is preferable that the inclination angle θ is in the range of 15 to 25 degrees. Evaluations are made to compare a case of reducing the clearance between the upper face of the upper die 9B and the upper face 5U of the upper die mounting groove 5 with a case of forming the bottom face 35 of the stop projection 31 into an inclined face. Standard upper dies each having 0.5 mm in the above-mentioned clearance when temporarily clamped (the inclination angle of the bottom face of the stop projection being zero), upper dies each having 15 degrees in the inclination angle of the bottom face 35, and precision upper dies each having 0.15 mm in the above-mentioned clearance when temporarily clamped (the inclination angle of the lower face of the stop projection being zero) are formed to have widths of 15 mm to 80 mm. The left-right center of the stop piece 19, which is arranged at a central part of each upper die, is shifted from the left-right center of the lock piece 13A as illustrated in FIG. 2(A), and in this state, the upper die is temporarily clamped. Thereafter, the upper die is firmly clamped in the upper die mounting groove 5, and then, is released to the temporarily clamped state. The firm clamping and the release to the temporarily clamped state are repeated ten times on each upper die, and thereafter, a displacement in the left-right direction is measured. Such measurement per ten times of repetition is carried out three times. Results of the measurement are illustrated in FIG. 5.

Figure 5:
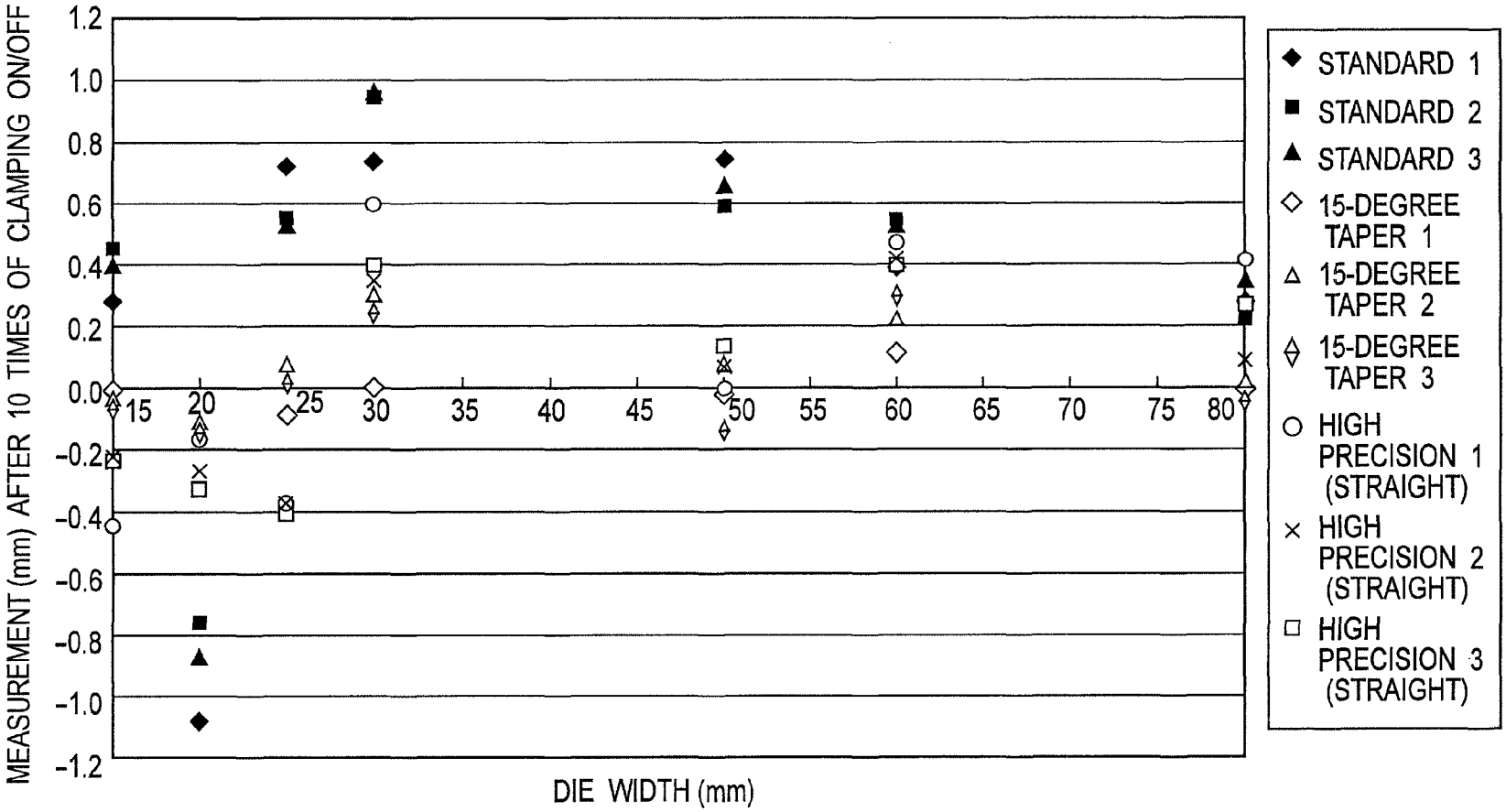
FIG. 5 is an explanatory view illustrating a displacement in the left-right direction when the temporary clamping and firm clamping of an upper die are repeated.

As is clear in FIG. 5, the standard upper dies demonstrate largest displacements and the precision upper dies follow. The upper dies each having the bottom face 35 of the stop projection 31 inclined by 15 degrees demonstrate minimum displacements. It is said, therefore, that the left-right displacement of an upper die that may occur when the upper die is firmly clamped from a temporarily clamped state is effectively suppressed if the bottom face 35 of the stop projection 31 is inclined to lift the upper die in advance with an upward component force during the temporary clamping of the upper die.

It is confirmed that inclining the bottom face 35 of the stop projection 31 is effective. A preferable range of inclination angles of the bottom face 35 is examined. As is clear in FIG. 4(A), an inclination angle smaller than 15 degrees causes a shortage of lift quantity and an inclination angle equal to or greater than 26 degrees increases a bearing stress to increase a frictional force occurring at the time of lifting. Accordingly, it is preferable that the inclination angle θ of the bottom face 35 of the stop projection 31 is in the range of 15 to 25 degrees.

As will be understood from the above explanation, the upper die 9B is temporarily clamped in the upper die mounting groove 5 of the upper die holder 3. At this time, the bottom face 35 of the stop projection 31 on the stop piece 19A of the upper die 9B is inclined. Accordingly, the resilient member 30 that pushes the stop piece 19A applies an upward component force to the bottom face 35, to upwardly push the upper die 9B. As a result, the upper face of the upper die 9B comes into contact with the upper face of the upper die mounting groove 5, or comes very close (0.15 mm or smaller) to the same. This prevents a left-right displacement when the upper die 9B is firmly clamped from the temporarily clamped state.

According to the configuration mentioned above, the resilient member 30 pushes the stop piece 19A leftward in FIG. 3(A). A reaction force thereof brings a back face (a right side face in FIG. 3(A)) of the upper die 9B into contact with a contact face 5R of the upper die mounting groove 5. If the contact face 5R is provided with die position detectors such as capacitance-type position detecting sensors known to be used for, for example, vernier calipers at regular intervals in the left-right direction, a detection gap with respect to the upper die 9B is always kept constant to realize a precision positional detection during the temporary clamping of the upper die.

The present invention is not limited to the above-mentioned embodiment and is properly modifiable to realize other embodiments. For example, an upper die 9 illustrated in FIG. 6 has a stop piece 19 whose lower part is connected through a hinge pin 39 to a receiving groove 21 formed in the upper die 9, so that the stop piece 19 is able to turn. When a resilient member 30 pushes a stop projection 31 of the stop piece 19 into a stop groove 7, a projecting part 41 arranged on a bottom face of the stop projection 31 comes into contact with a lower face 7F of the stop groove 7.

Figure 6:
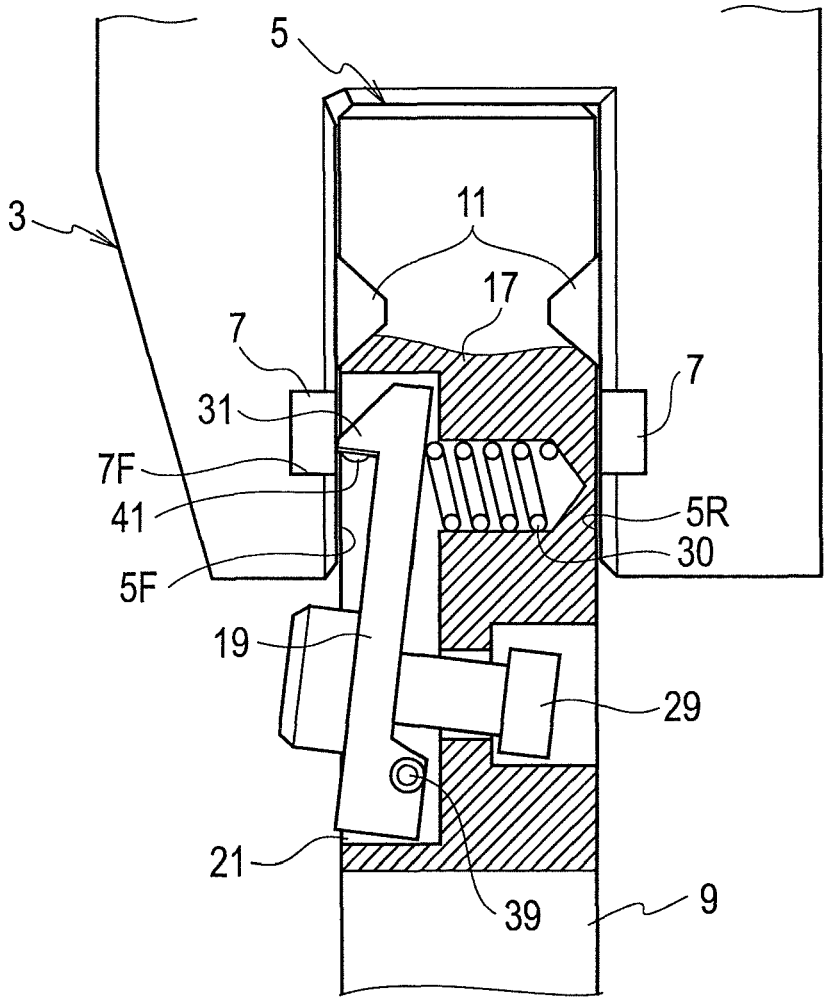
FIG. 6 is an explanatory view illustrating a configuration according to a second embodiment of the present invention.

According to the configuration mentioned above, a mounting part 17 of the upper die 9 is inserted into an upper die mounting groove 5 of an upper die holder 3 as illustrated in FIG. 6. In this state, the stop piece 19 is turned counterclockwise to bring the projecting part 41 arranged on the bottom face of the stop projection 31 of the stop piece 19 into contact with the lower face 7F of the stop groove 7. Thereafter, the stop piece 19 is further turned counterclockwise and the projecting part 41 turns to descend relative to the upper die 9. Namely, the upper die 9 ascends relative to the upper die mounting groove 5. When the stop piece 19 comes into contact with a front contact face 5F of the upper die mounting groove 5, a reaction force brings a right side face of the upper die 9 in FIG. 6 into contact with a contact face 5R.

Consequently, this configuration provides an effect similar to that provided by the before-mentioned embodiment.

According to the present invention, an upper die is mounted to and temporarily clamped in an upper die mounting groove. At this time, an inclined bottom face of a stop projection of a stop piece produces an upward component force to lift the upper die. As a result, an upper face of the upper die comes close to an upper face of the upper die mounting groove, to reduce a small gap between the upper face of the upper die and the upper face of the upper die mounting groove, or to bring the upper face of the upper die into contact with the upper face of the upper die mounting groove. This results in suppressing a small inclination of the upper die that may occur when the upper die is temporarily clamped in the upper die mounting groove and solving the problems mentioned before.

UNITED STATES DESIGNATION

In connection with United States designation, this international patent application claims the benefit of priority under 35 U.S.C. 119(a) to Japanese Patent Application No. 2012-117577 filed on May 23, 2012 whose disclosed contents are cited herein.

The invention claimed is:

1. An upper die assembly, comprising:

an upper die holder having an upper die mounting groove;

an upper die having a stop piece provided with a stop projection, the upper die being removable from the upper die mounting groove of the upper die holder in a downward direction with respect to an upper surface of the upper die mounting groove;

the upper die mounting groove being defined by opposing first and second upper die contact faces respectively extending in the downward direction from either side of the upper surface of the die mounting groove, the stop projection being engageable with a stop groove that is formed in each of first and second upper die contact faces and the stop piece is movable out of and into a surface of the upper die and is pushed in a direction to project out of the surface of the upper die; and a bottom face of the stop projection to be engaged with the stop groove is formed into an inclined face that rises toward a front end of the stop projection, wherein the inclined face contacts a lower edge of the stop groove when the stop projection is positioned within the stop groove.

2. The upper die as set forth in claim 1, wherein the bottom face of the stop projection is formed into an arcuate face around the center of an axis extending in a direction in which the first and the second upper die contact faces are spaced apart from each other.

3. The upper die as set forth in claim 1, wherein left and right side faces of the stop projection are inclined in the direction in which the first and the second upper die contact faces are spaced apart from each other so that the stop projection gradually narrows toward the front end thereof.

4. The upper die as set forth in claim 1, wherein the stop piece is arranged at a central part of the upper die and an inclination angle of the bottom face of the stop projection is in the range of 15 to 25 degrees.

5. A method of temporarily clamping the upper die set forth in claim 1 to an upper table of a press brake, the method comprising:

inserting an upper part of the upper die into an upper die mounting groove that is arranged at a lower part of the upper table, engaging the stop projection, which is arranged to be movable out of and into a surface of the upper die and to be pushed in a direction to project out of the surface of the upper die, with a stop groove that is formed in each of the first and second upper die contact faces of the upper die mounting groove, and upwardly pushing the upper die with an upward component force acting on the inclined bottom face of the stop projection.

* * * * *